US009194677B1

(12) United States Patent
Skaret et al.

(10) Patent No.: US 9,194,677 B1
(45) Date of Patent: Nov. 24, 2015

(54) PROJECTILE WITH AFT OBTURATING DEVICE

(71) Applicant: Raytheon Company, Waltham, MA (US)

(72) Inventors: Justin D Skaret, Tucson, AZ (US); Conan L Davis, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 316 days.

(21) Appl. No.: 13/850,630

(22) Filed: Mar. 26, 2013

(51) Int. Cl.
*F42B 14/06* (2006.01)

(52) U.S. Cl.
CPC ..... *F42B 14/064* (2013.01); *F42B 14/067* (2013.01)

(58) Field of Classification Search
CPC ..... F42B 14/06; F42B 14/061; F42B 14/062; F42B 14/064; F42B 14/067; F42B 14/068; F42B 14/08
USPC ..... 102/520, 521, 522, 523
See application file for complete search history.

(56) References Cited

U.S. PATENT DOCUMENTS

| | | | | |
|---|---|---|---|---|
| 2,870,711 | A * | 1/1959 | Barr et al. | 244/3.27 |
| 3,687,079 | A * | 8/1972 | Scollins | 102/526 |
| 4,552,071 | A * | 11/1985 | Horais et al. | 102/527 |
| 4,936,220 | A * | 6/1990 | Burns et al. | 102/521 |
| 6,492,632 | B1 * | 12/2002 | Pollin | 244/3.3 |
| 2004/0200375 | A1 * | 10/2004 | Kautzsch et al. | 102/385 |
| 2008/0257192 | A1 * | 10/2008 | Schaeffer | 102/438 |

* cited by examiner

*Primary Examiner* — Stephen M Johnson
(74) *Attorney, Agent, or Firm* — Renner, Otto, Boisselle & Sklar, LLP

(57) ABSTRACT

A projectile, such as a guided mortar projectile, has both a front obturator and an aft obturating device. The aft obturating device is located aft of the front obturator, and serves to trap pressurized gases behind the aft obturating device, so as to provide further propulsion to the projectile with the trapped pressurized gases, even after the front obturator has cleared the muzzle of a launcher. The aft obturating device provides less resistance to movement of pressurized gases across the aft obturating device in the aft direction, than to movement of pressurized gases across the aft obturating device in the forward direction, and may act as a check valve with regard to such gas flows. The aft obturating device may be part of a cap that is coupled to a tail boom of the projectile, and that drops away from the projectile after launch.

20 Claims, 4 Drawing Sheets

PROJECTILE WITH AFT OBTURATING DEVICE

BACKGROUND OF THE INVENTION

1. Technical Field of the Invention

The invention is in the field of ballistic projectiles, such as mortar rounds or other rounds fired from launchers.

2. Description of the Related Art

Ballistic projectiles launched from launchers, such as mortars launched from mortar tubes, have long been used in combat. Mortars have the advantage of being able to be carried by infantry, having a low cost, and being of small size (and thus hard to detect), thus providing reasonably accurate artillery support. Increasing the range for such projectiles is advantageous, without sacrificing the features of such systems which make them attractive in the first place.

SUMMARY OF THE INVENTION

According to an aspect of the invention, a projectile has a front obturator and an aft obturating device.

According to another aspect of the invention, a projectile has an obturating device with asymmetric flow resistance, providing more resistance to flow across the obturating device in a forward than to flow across the obturating device in a rearward direction.

According to yet another aspect of the invention, a projectile has an obturating device which allows flow in a rearward direction, but not in a forward direction.

According to a further aspect of the invention, a tail boom for use with a projectile has an obturating device with asymmetric flow resistance, providing more resistance to flow across the obturating device in a forward than to flow across the obturating device in a rearward direction.

According to a still further aspect of the invention, a projectile launchable from a launcher includes: a projectile body; a propellant on the body; a forward obturator on the body, wherein the forward obturator is forward of the propellant; and an aft obturating device that is aft of the propellant. The aft obturating device contains pressurized gas that is behind the projectile in the launcher, after the forward obturator has cleared the launcher.

According to another aspect of the invention, a tail boom for mounting to a ballistic projectile includes: fins; and an aft obturating device that is aft of propellant that is on the tail boom. The aft obturating device provides greater resistance to flow of pressurized gas from aft of the aft obturating device to forward of the aft obturating device, than to flow of pressurized gas from forward of the aft obturating device to aft of the aft obturating device, enabling the aft obturating device to contain pressurized gas behind the aft obturating device.

According to yet another aspect of the invention, a method of firing a projectile from a launcher includes: burning propellant of the projectile to produce pressurized gases in the launcher; and accelerating the projectile within the launcher using the pressurized gases. The accelerating includes: containing at least some of the pressurized gases within the launcher using a forward obturator; and after the forward obturator has exited the launcher, containing some of the pressurized gases within the launcher using an aft obturating device of the projectile, wherein the aft obturating device is aft of the forward obturator.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

DETAILED DESCRIPTION

A projectile, such as a guided mortar projectile, has both a front obturator and an aft obturating device. The aft obturating device is located aft of the front obturator, and serves to trap pressurized gases behind the aft obturating device, so as to provide further propulsion to the projectile with the trapped pressurized gases, even after the front obturator has cleared the muzzle of a launcher. The aft obturating device provides less resistance to movement of pressurized gases across the aft obturating device in the aft direction, than to movement of pressurized gases across the aft obturating device in the forward direction. The aft obturating device may act as a check valve, allowing gas flow only in the aft direction, while substantially preventing gas flow across the device in the forward direction. The aft obturating device may be part of a cap that is coupled to a tail boom of the projectile, and that drops away from the projectile after launch.

Figure 1:
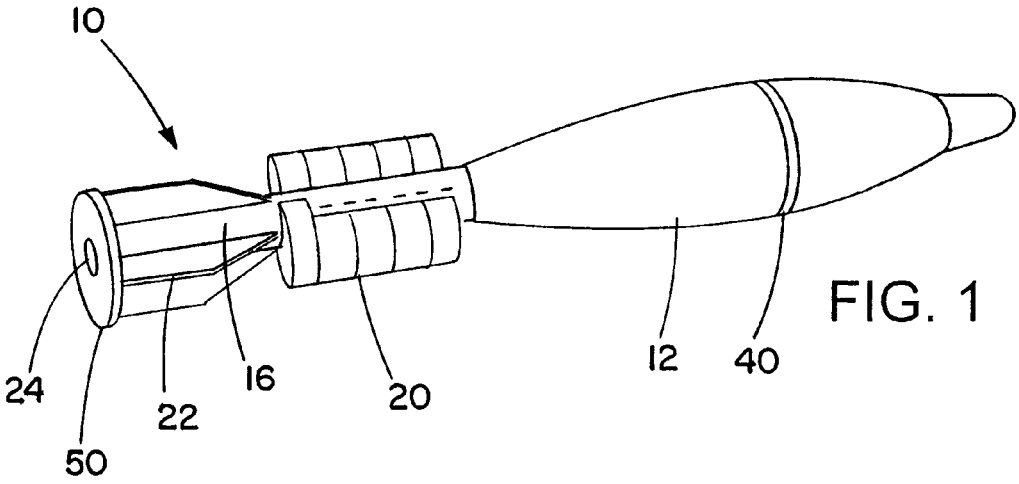
FIG. 1 is an oblique view of a projectile in accordance with an embodiment of the invention.

FIG. 1 shows a projectile 10, used for launch from a launcher. The projectile 10 may be a mortar round (or shell or mortar bomb) for launch from a mortar or other launch tube, or may be other types of ballistic rounds. The projectile includes a main body 12 that houses the payload for the projectile, for instance an explosive, incendiary material, or smoke-producing material. The main body 12 may also include a guidance system for guiding the projectile 10 during flight, making the projectile a guided projectile.

Figure 2:
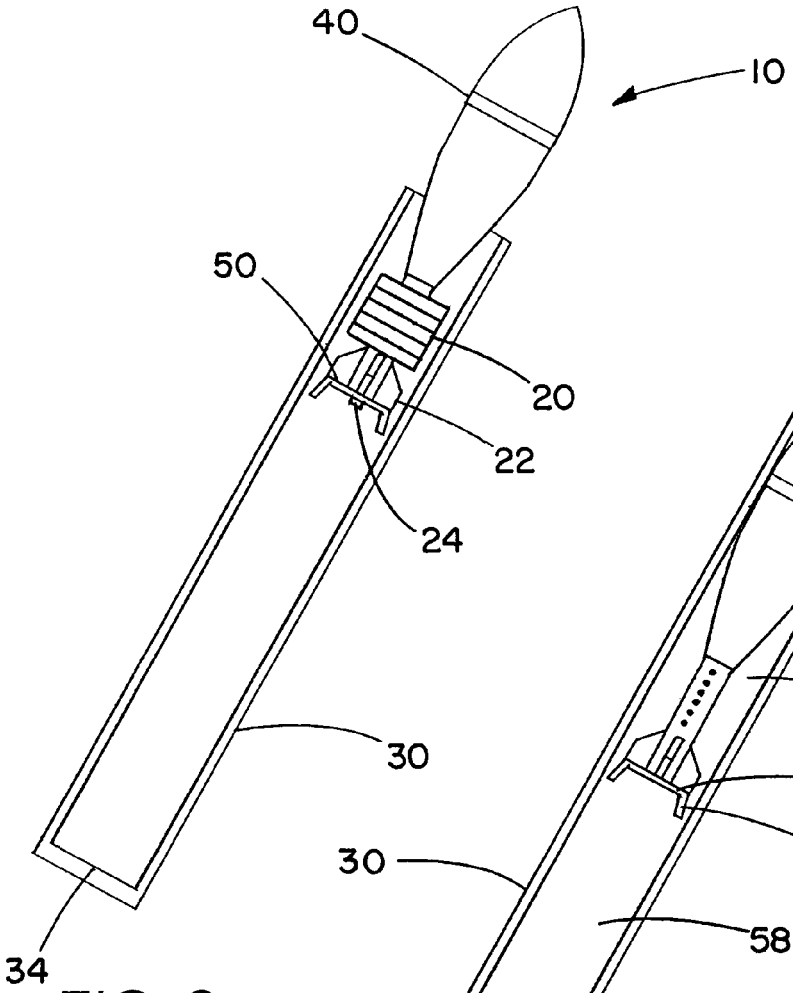
FIG. 2 is a side cutaway view illustrating the projectile of FIG. 1 being inserted into a launcher.

A tail boom 16 of the projectile 10 extends aft from the main body 12. A series of propellant charges 20 surround the tail boom 16, forward of fins 22. The propellant charges 20 may be inserted in one or more holes in the tail boom 16. Range of the projectile 10 can be controlled by selecting a proper number of the propellant charges 20. Combustion of the propellant material in the charges 20 produces pressurized gases that are used to launch the projectile 10. The combustion is initiated by a primer 24 that is at the base of the tail boom 16. With reference now in addition to FIG. 2, when the projectile 10 is dropped into the muzzle of a launcher 30 it slides down until it hits the bottom of the launcher 30. A firing pin 34 is at the bottom of the launcher. The primer 24 striking the firing pin 34 initiates combustion of the propellant that is within the propellant charges 20. The firing pin 34 detonates, and the pressurized gases produced by the detonation travel through passages in the tail boom 16 to detonate the propellant charges 20. This produces pressurized gases that drive the projectile 10 out of the launcher.

The pressurized gases are initially contained by a forward obturator 40 that is on the main body 12. The forward obturator 40 provides sealing between the projectile 10 and the muzzle of the launcher 30 (a seal that is maintained as the projectile 10 moves within the launcher 30), so as to keep the pressurized gases behind the obturator 40 from leaking out. This allows the full force from the pressurized gases to be used to propel the projectile 10.

The projectile 10 also has an aft obturating device 50 that is used to capture more of the force of the pressurized gases, even after the forward obturator 40 clears the muzzle of the launcher 30. The obturating device 50 is located at the aft end of the projectile 10, aft of the propellant charges 20. In the illustrated embodiment the aft obturating device 50 is located at the back end of the tail boom 16, around or slightly forward of the primer 24 (while leaving the primer 24 exposed for collision with the firing pin 34).

The aft obturating device 50 does not provide a perfect seal against any pressurized gases moving across it. Instead it preferentially allows flow from front to back, providing less flow resistance for backward flow than for forward flow. This allows pressurized gases produced by the propellant charges 20 to move backward past the aft obturating device 50, while at least partially trapping the pressurized gases behind the aft obturating device 50. In one embodiment, the aft obturating device 50 acts as a check valve, providing a seal to fully trap the pressurirized gases behind the aft obturating device 50.

Several configurations are possible for the aft obturating device 50. The aft obturating device 50 may have one or more movable parts that shift position to allow flow in an aft direction, while preventing flow in a forward direction. The parts may be flaps or other coverings for holes, for example.

Alternatively the aft obturating device may itself change shape to preferentially allow flow in the aft direction, changing shape from a shape which allows flow in the aft direction (when the pressure is higher in front of the aft obturating device that in back of the aft obturating device), to a shape that at least in part blocks flow in the forward direction (when the pressure is higher in back of the aft obturating device that in front of the aft obturating device). For example, an outer ring of the aft obturating device 50 may be flexible, and able to flex afterward to open up a passage for pressurized gases moving forward to back, while pressurized gases behind the obturating device 50 flex the outer ring to close up the passages, to restrict or prevent flow of gases in a forward direction.

As another alternative, the aft obturating device 50 may have a fixed shape that provides different flow resistance for flows in the forward and aft directions. For example the aft obturating device 50 might have a curved cup shape, with the center of curvature behind the device 50. This provides a relatively low coefficient of drag for flow in the aft direction, and a relatively high coefficient of drag for gas flow across the aft obturating device 50 in the forward direction.

In another example of a fixed configuration, the aft obturating device could have a series of holes extending through it in a longitudinal (axial) direction, with the holes having cross-sectional areas and/or shapes that provide greater flow resistance to flow in the forward direction.

Some example configurations for the aft obturating device 50 are disclosed herein. These examples are only a few specific examples of the many possible configurations that could be used.

Figure 3:
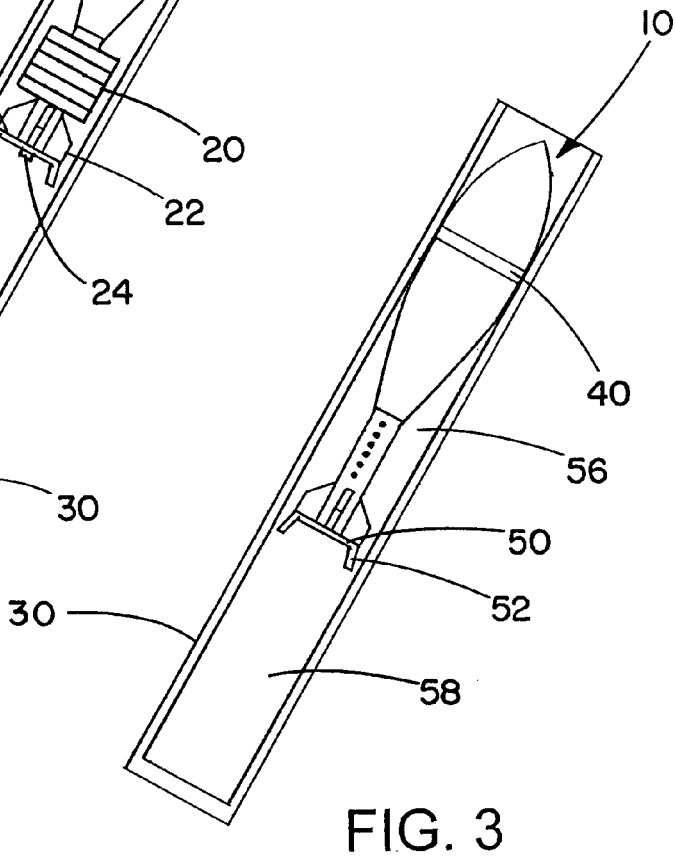
FIG. 3 is a side cutaway view of a first step in launching of the projectile of FIG. 1.
Figure 4:
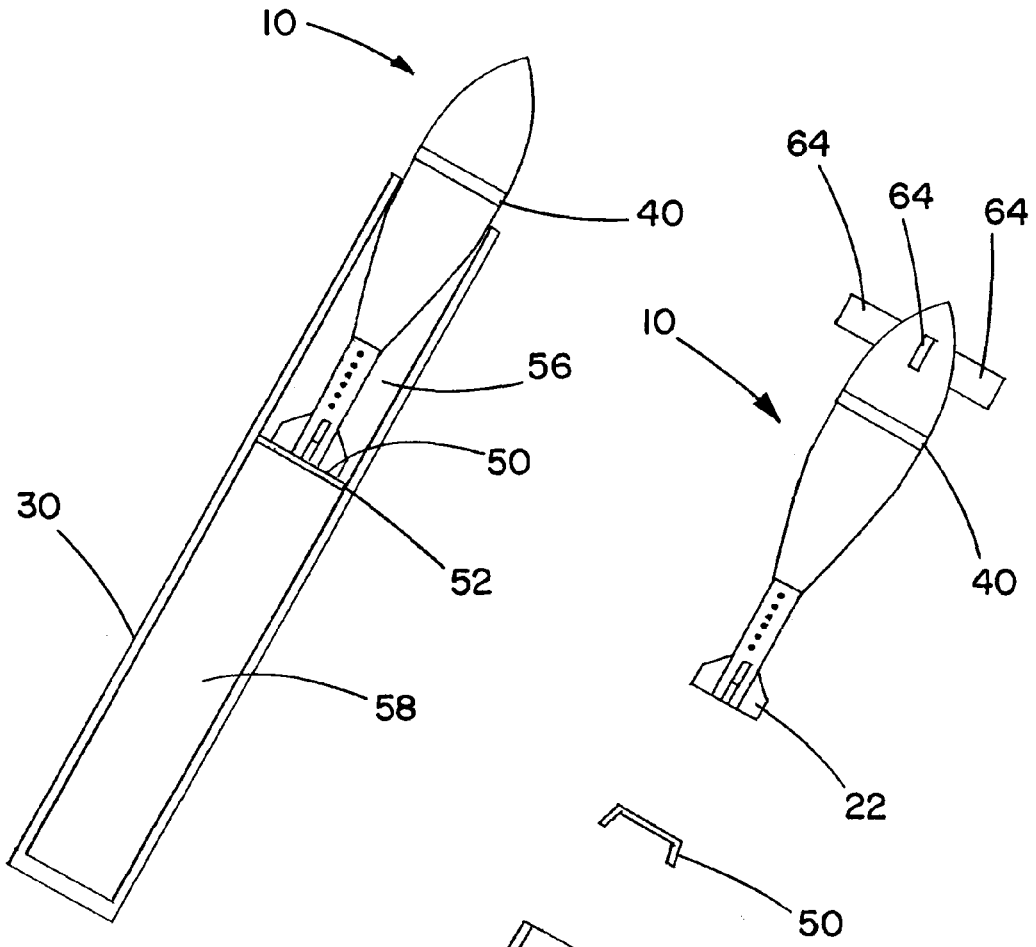
FIG. 4 is a side cutaway view of a second step in launching of the projectile of FIG. 1.
Figure 5:
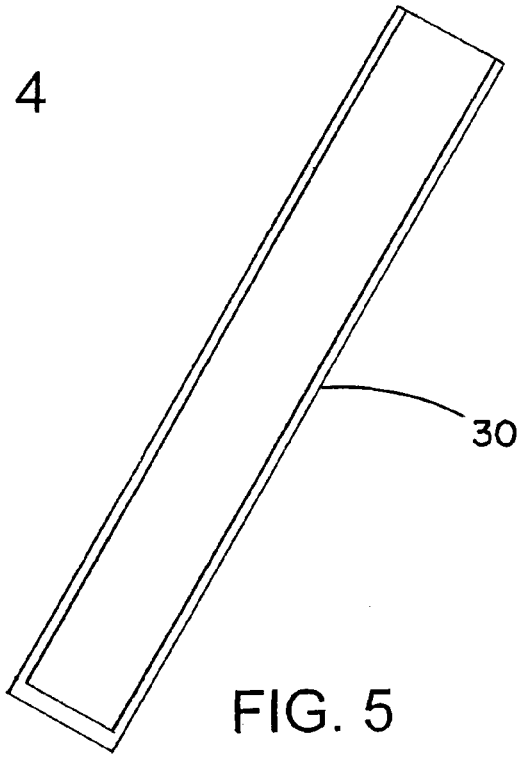
FIG. 5 is a side cutaway view of a third step in launching of the projectile of FIG. 1.

FIGS. 3-5 illustrate operation of the projectile 10 with one embodiment of the aft obturating device 50, an embodiment in which an outer annular ring 52 of the aft obturating device 50 is able to change position, to either provide sealing, or to let flow past the aft obturating device 50. The annular ring 52 may be hingedly coupled to the rest of the obturating device, for example by a flexible material such as rubber, which may be scored or otherwise treated to preferentially allow it to bend in one direction. The illustrated embodiment of the aft obturating device 50 is thus an example of a device that changes shape.

FIG. 3 shows the situation when the forward obturator 40 is still providing sealing between the projectile 10 and the muzzle of the launcher 30. The propellant charges (FIG. 1) have already been consumed, producing the pressurized gases that fill the portion of the launcher 30 that is behind the forward obturator 40. The annular ring 52 deflects rearward to allow flow of pressurized gases from a space 56 between the forward obturator 40 and the aft obturating device 50, to the space 58 completely behind the projectile 10.

FIG. 4 shows the situation later in time, when the forward obturator 40 has cleared the muzzle of the launcher 30. This allows the pressurized gases in the space 56 to escape. However the annular ring 52 bends outward under the pressure difference between the relatively high pressure in the space 58 behind the aft obturating device 50, and the relatively low pressure in the space 56. This contains the pressurized gases in the space 58 so as to allow the pressurized gases in the space 58 to continue to provide force to accelerate the projectile 10.

When the projectile 10 has fully cleared the launcher 30, as shown in FIG. 5, the aft obturating device 50 may separate from the rest of the projectile 10 and fall away. This reduces the weight of the projectile 10, and eliminates the drag that the aft obturating device 50 may otherwise produce on the projectile 10. The aft obturating device 50 initially may be lightly mechanically coupled to the rest of the projectile 10, for example using an adhesive, such that aerodynamic forces in flight cause the aft obturating device 50 to separate from the rest of the projectile 10. Alternatively, the aft obturating device 50 may remain connected to the rest of the projectile 10 throughout flight of the projectile 10.

In flight, canards 64 of the projectile 10 deploy. The canards 64 may deploy from slots in the main body 12, using springs or other suitable mechanisms. The canards 64, or other suitable steering mechanism, are used to steer the projectile 10, with a suitable control system (not shown), and perhaps a suitable communications system (not shown), operatively coupled to the canards 64. The projectile 10 can be steered to correct its course, and/or to change its course. In particular, the steering of the projectile 10 may be used to correct for tip off or other course anomalies introduced by the launch mechanism. The use of the aft obturating device 50 may introduce wobbling into the flight of the projectile 10, for example by imposing nonaxisymmetric forces on projectile 10 after the forward obturator 40 clears the muzzle of the launcher 30.

The use of the aft obturating device 50 provides more efficient use of the pressurized gases produced by the combustion of the propellant charges 22. The aft obturating device 50 increases the effective length of the launcher 30, allowing capture of some of the impulse available from the pressurized gases that would otherwise be lost. The result is an increase in range of the projectile 10, with the steering or guidance of the projectile 10 maintaining the accuracy of the projectile 10. The range enhancement is accomplished without any significant increase in the overall length of the projectile 10, and without any significant penalty in terms of the weight of the projectile 10. This is in contrast to projectiles that are modified to increase range by attaching a rocket booster to the rear end of the projectile. Such rocket boosters significantly increase the length of projectiles, and also have significant weight and size, making them burdensome to carry. The use of such rocket boosters may reduce the number of rounds that may be hand-carried by a soldier.

As an alternative the projectile 10 may be an unguided projectile 10. Without guidance the projectile 10 would have the benefits of the aft obturating system 50, but would be expected to increase dispersion in its targeting.

Figure 6:
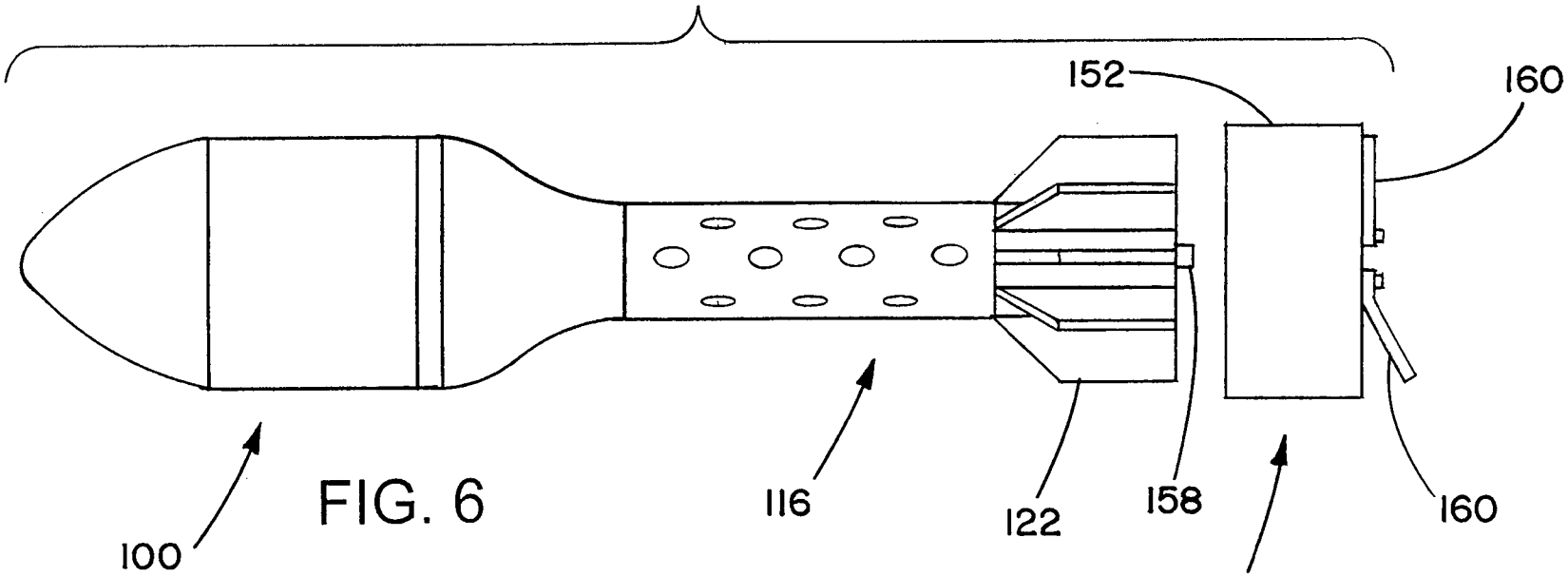
FIG. 6 is a side exploded view of a projectile in accordance with another embodiment of the present invention.
Figure 7:
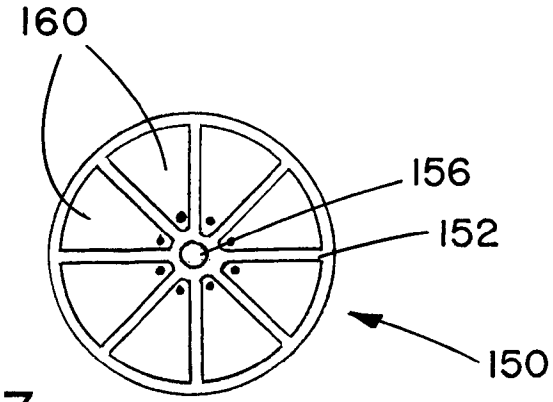
FIG. 7 is a rear end view of the projectile of FIG. 6.

FIGS. 6 and 7 show a projectile 100 with an alternative configuration aft obturating device 150 on its tail boom 116. The aft obturating device 150 includes has a body 152 that slides onto fins 122 of the projectile 100. The body 152 may be made of plastic or another suitable, preferably lightweight, material. The body 152 is hollow, with the fins 122 fit into the body 152. The body 152 also includes a central hole 156 to allow a firing pin 158 to pass through.

At the back end of the body 152 are a series of reed valves 160, hinged triangular pieces that act as check valves. The reed valves 160 hingedly open backwards to allow gas to flow aftward through the body 152, and close to prevent gas flow in the opposite direction. The obturating device 150 therefore is an example of a device that has moving parts, one that may substantially fully prevent flow in a forward direction, and one that separates from the projectile 100 after launch.

In other respects the projectile 100 may be similar to the projectile 10 (FIG. 1). Different features of the aft obturating devices of the two projectiles may be combinable with one another, as appropriate.

Figure 8:
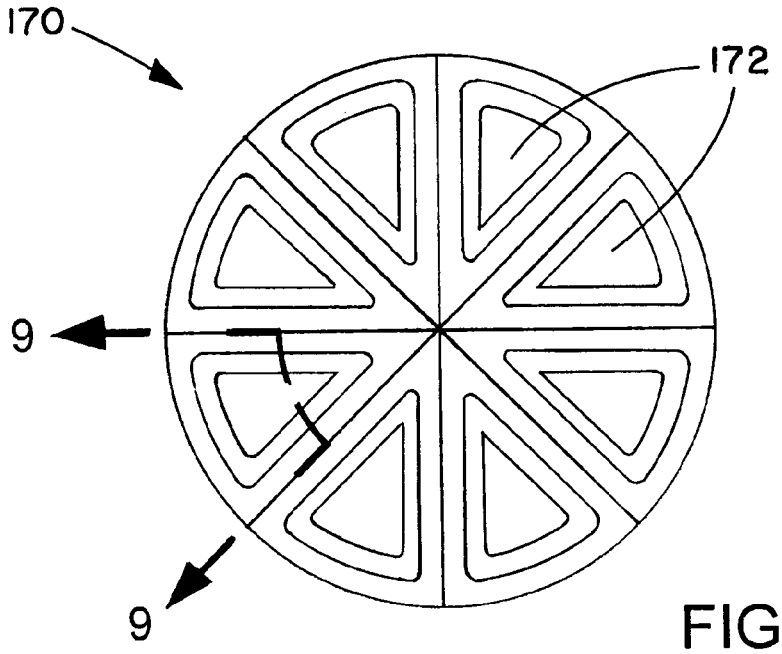
FIG. 8 is a rear end view of an obturating device in accordance with yet another embodiment of the present invention.
Figure 9:
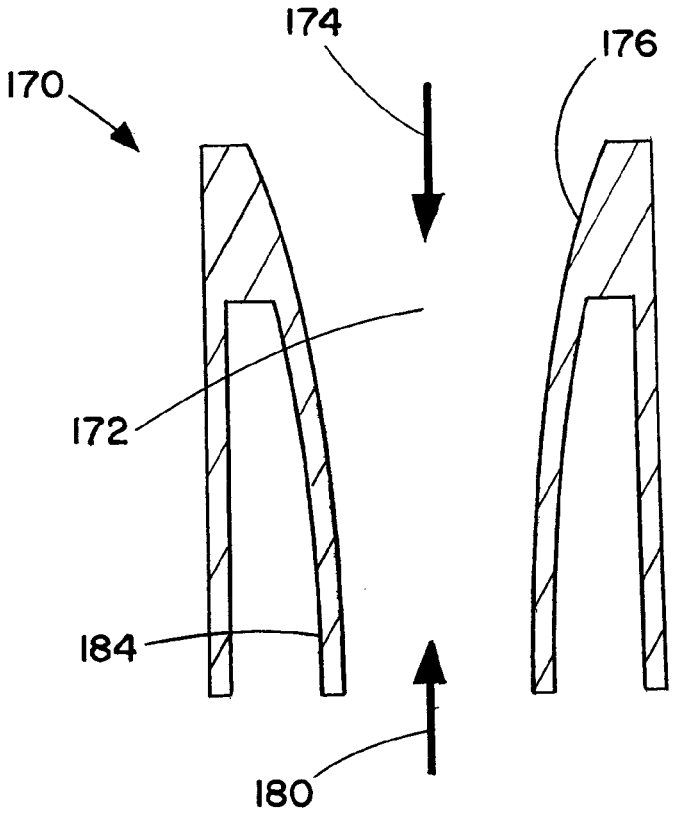
FIG. 9 is a cross-sectional view of a portion of obturating device of FIG. 8, along section 9-9 of FIG. 8.

FIGS. 8 and 9 show another alternative configuration, an aft obturating device 170 that is similar in overall size and shape to the obturating device 150 (FIGS. 6 and 7). Instead of the reed valves 160, the obturating device 170 has fixed openings 172 that provide different flow resistance for gas flow in the aft and forward directions. Gas flow in the aft direction 174 encounters a curved surface 176 that provides relatively low resistance to flow in that direction. Flow in the opposite direction, the forward direction 180, faces a high flow resistance cupped surface 184. The obturating device 170 is an example of an obturating device with a fixed shape. Alternative devices are possible with any of a variety of numbers, types, and configurations of openings.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A projectile launchable from a launcher comprising:
a projectile body;
a propellant on the body;
a forward obturator on the body, wherein the forward obturator is forward of the propellant; and
an aft obturating device that is aft of the propellant;
wherein the aft obturating device contains pressurized gas that is behind the projectile in the launcher, after the forward obturator has cleared the launcher;
wherein the aft obturating device reversibly provides greater resistance to flow of pressurized gas from aft of the aft obturating device to forward of the aft obturating device, than to flow of pressurized gas from forward of the aft obturating device to aft of the aft obturating device.

2. The projectile of claim 1, wherein the aft obturating device acts as a check valve, allowing flow of pressurized gas from forward of the aft obturating device to aft of the aft obturating device, while substantially blocking flow of pressurized gas from aft of the aft obturating device to forward of the aft obturating device.

3. The projectile of claim 1, wherein an outer portion of the aft obturating device forms a seal with a muzzle of the launcher during launching.

4. The projectile of claim 3, wherein the outer portion forms the seal only after the forward obturator clears the muzzle.

5. The projectile of claim 1, wherein the aft obturating device changes shape from a shape which allows flow in the aft direction, when pressure in front of the aft obturating device is higher than pressure in back of the aft obturating device, to a shape that at least in part blocks flow in the forward direction, when the pressure in back of the aft obturating device is higher than the pressure in front of the aft obturating device.

6. The projectile of claim 1, wherein the aft obturating device has a fixed shape that provides different flow resistance for flows in the forward direction and the aft direction.

7. The projectile of claim 1, wherein the aft obturating device separates from a remainder of the projectile during flight.

8. The projectile of claim 7, wherein the aft obturating device is part of a cap that fits over at least part of fins of the projectile.

9. The projectile of claim 1, wherein the aft obturating device includes reed valves hingedly coupled to an aft obturating device body of the aft obturating device.

10. The projectile of claim 1, wherein the projectile is a guided projectile.

11. The projectile of claim 10, wherein the projectile includes control surfaces that deploy from the body during flight of the projectile, and that are usable to control flight of the projectile.

12. A projectile launchable from a launcher comprising:
a projectile body;
a propellant on the body;
a forward obturator on the body, wherein the forward obturator is forward of the propellant; and
an aft obturating device that is aft of the propellant;
wherein the aft obturating device contains pressurized gas that is behind the projectile in the launcher, after the forward obturator has cleared the launcher;

wherein the aft obturating device includes one or more movable parts that reversibly shift position to allow flow in an aft direction, while at least in part preventing flow in a forward direction.

13. The projectile of claim 12, wherein the aft obturating device acts as a check valve, allowing flow of pressurized gas from forward of the aft obturating device to aft of the aft obturating device, while substantially blocking flow of pressurized gas from aft of the aft obturating device to forward of the aft obturating device.

14. The projectile of claim 12, wherein the aft obturating device includes reed valves hingedly coupled to an aft obturating device body of the aft obturating device.

15. The projectile of claim 12, wherein the aft obturating device changes shape from a shape which allows flow in the aft direction, when pressure in front of the aft obturating device is higher than pressure in back of the aft obturating device, to a shape that at least in part blocks flow in the forward direction, when the pressure in back of the aft obturating device is higher than the pressure in front of the aft obturating device.

16. A projectile launchable from a launcher comprising:

a projectile body;

a propellant on the body;

a forward obturator on the body, wherein the forward obturator is forward of the propellant; and an aft obturating device that is aft of the propellant;

wherein the aft obturating device contains pressurized gas that is behind the projectile in the launcher, after the forward obturator has cleared the launcher;

wherein the body includes a main body and a tail boom attached to the main body; and wherein the aft obturating device is mounted on the tail boom.

17. The projectile of claim 16, wherein the aft obturating device acts as a check valve, allowing flow of pressurized gas from forward of the aft obturating device to aft of the aft obturating device, while substantially blocking flow of pressurized gas from aft of the aft obturating device to forward of the aft obturating device.

18. The projectile of claim 16, wherein the aft obturating device includes reed valves hingedly coupled to an aft obturating device body of the aft obturating device.

19. The projectile of claim 16, wherein the aft obturating device changes shape from a shape which allows flow in the aft direction, when pressure in front of the aft obturating device is higher than pressure in back of the aft obturating device, to a shape that at least in part blocks flow in the forward direction, when the pressure in back of the aft obturating device is higher than the pressure in front of the aft obturating device.

20. The projectile of claim 16, wherein the aft obturating device has a fixed shape that provides different flow resistance for flows in the forward direction and the aft direction.

* * * * *